US006685155B1

(12) United States Patent
Chen

(10) Patent No.: US 6,685,155 B1
(45) Date of Patent: Feb. 3, 2004

(54) NET FIXING RACK STRUCTURE

(76) Inventor: Benjamin Chen, No. 1, Alley 16, Lane 4D, Jinn Te Rd., Taichung (TW)

( * ) Notice: Subject to any disclaimer, the term of this patent is extended or adjusted under 35 U.S.C. 154(b) by 0 days.

(21) Appl. No.: 10/389,575

(22) Filed: Mar. 12, 2003

(51) Int. Cl.[7] ..... A01K 97/10

(52) U.S. Cl. ..... 248/533; 248/156; 248/530; 248/545; 473/492

(58) Field of Search ..... 248/156, 545, 248/500, 530, 533, 532; 52/157, 165, 156; 473/472, 494, 492

(56) References Cited

U.S. PATENT DOCUMENTS 4,662,139 A * 5/1987 Bollmann ..... 52/296
4,850,564 A * 7/1989 Padin ..... 248/533
4,993,719 A * 2/1991 Hernandez ..... 273/411
5,106,101 A * 4/1992 McKay ..... 273/411
5,326,109 A * 7/1994 Robl ..... 273/411

FOREIGN PATENT DOCUMENTS

EP 0 078 744 A1 * 10/1982

* cited by examiner

*Primary Examiner*—Gwendolyn Baxter

(57) ABSTRACT

A net fixing rack structure includes a base, a fixing tube, and a mounting tube. The base is formed with an oblique through hole. The fixing tube has a first end formed with a pin rod and a screw portion and a second end formed with a transverse through hole. The mounting tube is mounted on the fixing tube. The oblique through hole of the base has a determined inclined angle, so that the fixing tube is fixed in the ground with a determined inclined angle. Thus, after the whole net fixing rack structure is assembled, the mounting tube is inclined relative to the ground with a determined angle, thereby enhancing the supporting effect of the net fixing rack structure.

5 Claims, 8 Drawing Sheets

NET FIXING RACK STRUCTURE

BACKGROUND OF THE INVENTION

1. Field of the Invention

The present invention relates to a net fixing rack structure, and more particularly to a net fixing rack structure that after assembly is inclined relative to the ground with a determined angle, thereby enhancing the supporting effect of the net fixing rack structure.

2. Description of the Related Art

A conventional net fixing rack structure in accordance with the prior art shown in FIGS. 1 and 2 is mounted on each of two opposite sides of a net 50A, and comprises a tube 20A having an upper end secured on each of the two opposite sides of the net 50A, and a fixing block 40 made of steel material secured on a lower end of the tube 20A. However, the fixing block 40 is fixed on the ground by a tool, such as a hammer, thereby easily injuring the user by the hammer. In addition, the friction between the fixing block 40 and the ground is insufficient, so that the fixing block 40 easily detaches from the ground.

SUMMARY OF THE INVENTION

The present invention has arisen to mitigate and/or obviate the disadvantage of the conventional net fixing rack structure.

The primary objective of the present invention is to provide a net fixing rack structure, wherein the oblique through hole of the base has a determined inclined angle, so that the fixing tube is fixed in the ground with a determined inclined angle. Thus, after the whole net fixing rack structure is assembled, the mounting tube is inclined relative to the ground with a determined angle, thereby enhancing the supporting effect of the net fixing rack structure.

Another objective of the present invention is to provide a net fixing rack structure, wherein when the fixing tube is fixed in the ground, the screw portion of the fixing tube has a better grabbing effect, thereby enhancing the combination effect between the fixing tube and the ground, so that the fixing tube is fixed in the ground rigidly and stably.

A further objective of the present invention is to provide a net fixing rack structure, wherein the fixing tube is successively rotated and moved downward until the transverse through hole of the fixing tube is flush with the oblique through hole of the base, so that the user may assure that the fixing tube is inserted into the ground to a determined depth, thereby enhancing the safety of mounting the net fixing rack structure.

In accordance with the present invention, there is provided a net fixing rack structure, comprising a base, a fixing tube, and a mounting tube, wherein:

the base is mounted on the ground, and is formed with an oblique through hole having a proper height;

the fixing tube is mounted on the base, and has a first end formed with a pin rod and a second end formed with a transverse through hole, the fixing tube includes a screw portion mounted on a periphery of the pin rod, the screw portion and the pin rod of the fixing tube are extended through the oblique through hole of the base; and the mounting tube is mounted on the fixing tube, and has a distal end connected to the oblique through hole of the base.

Further benefits and advantages of the present invention will become apparent after a careful reading of the detailed description with appropriate reference to the accompanying drawings.

DETAILED DESCRIPTION OF THE INVENTION

Figure 1:
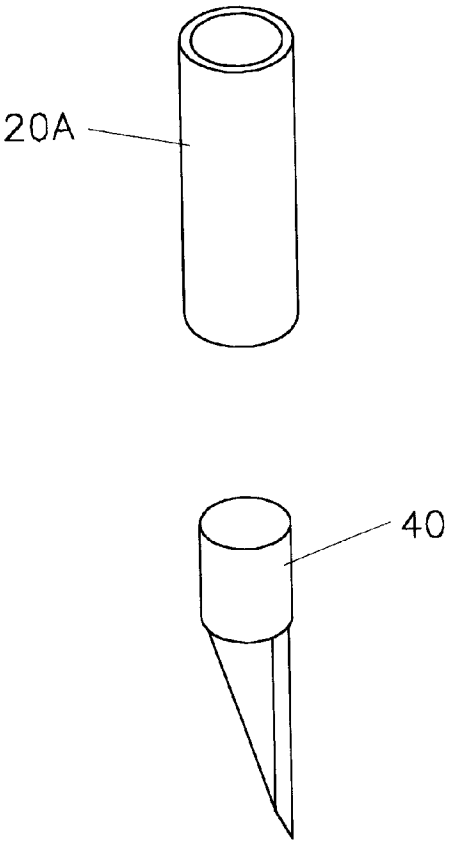
FIG.1 PRIOR ART
FIG. 1 is an exploded perspective view of a conventional net fixing rack structure in accordance with the prior art.
Figure 2:
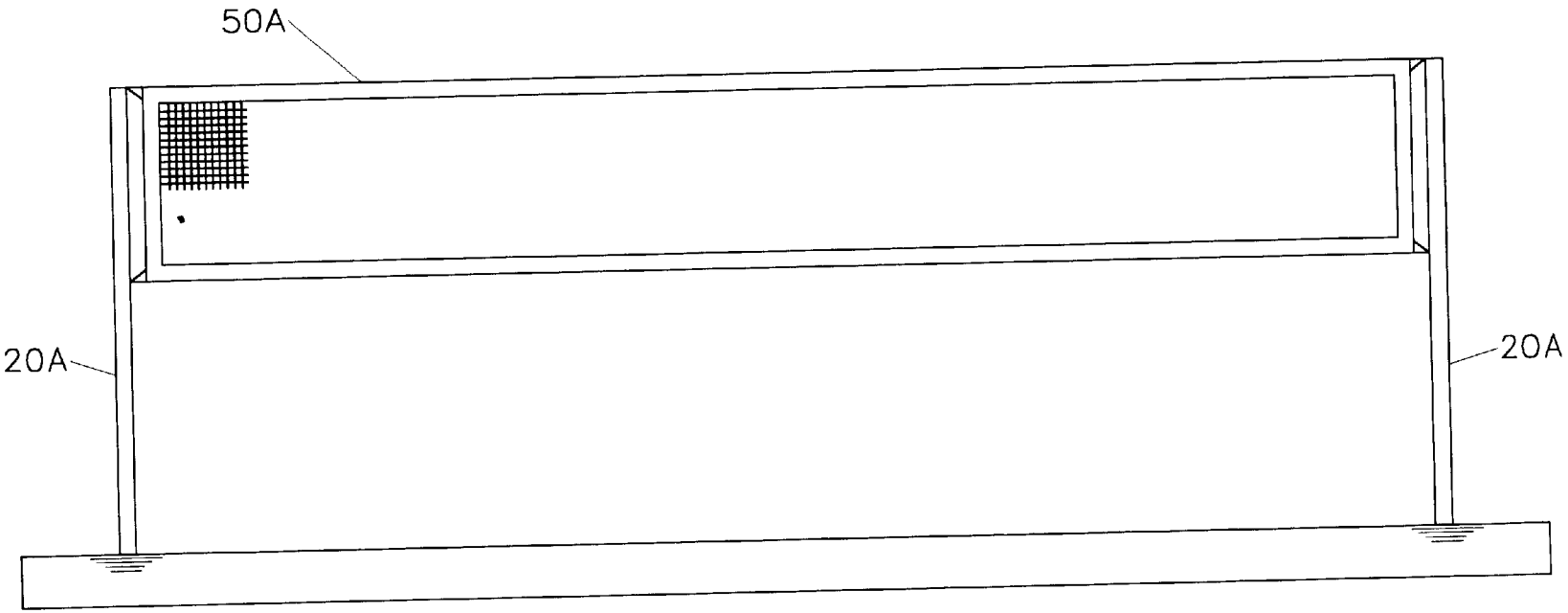
FIG.2 PRIOR ART
FIG. 2 is a schematic plan assembly view of the conventional net fixing rack structure as shown in FIG. 1.
Figure 3:
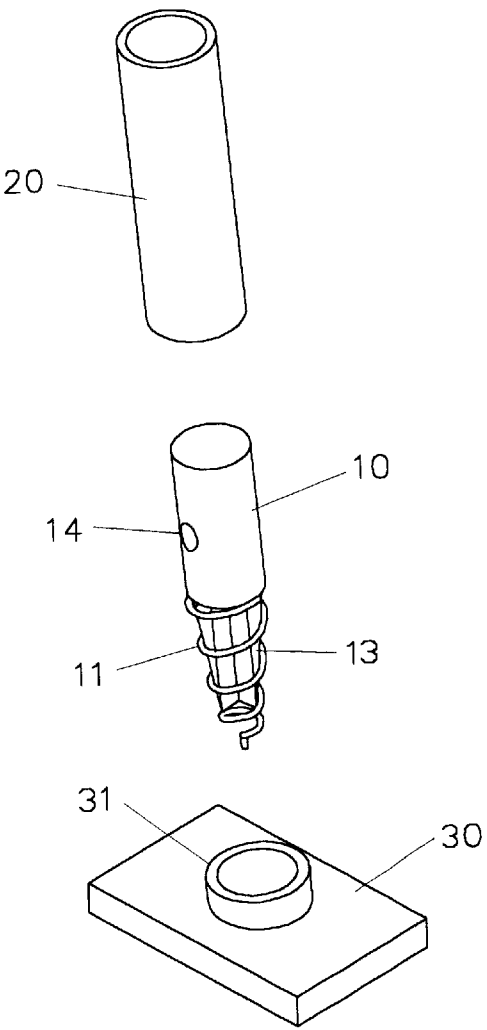
FIG. 3 is an exploded perspective view of a net fixing rack structure in accordance with a first embodiment of the present invention.

Referring to the drawings and initially to FIGS. 3–6, a net fixing rack structure in accordance with a first embodiment of the present invention is mounted on each of two opposite sides of a net 50 (see FIG. 6), and comprises a base 30, a fixing tube 10, and a mounting tube 20.

The base 30 is mounted on the ground, and is formed with an oblique through hole 31 having a proper height.

The fixing tube 10 is mounted on the base 10, and has a first end formed with a pin rod 13 and a second end formed with a transverse through hole 14. The fixing tube 10 includes a screw portion 11 mounted on a periphery of the pin rod 13. In addition, the screw portion II and the pin rod 13 of the fixing tube 10 are extended through the oblique through hole 31 of the base 30.

The mounting tube 20 is mounted on the fixing tube 10, and has a distal end connected to the oblique through hole 31 of the base 30.

Figure 4:
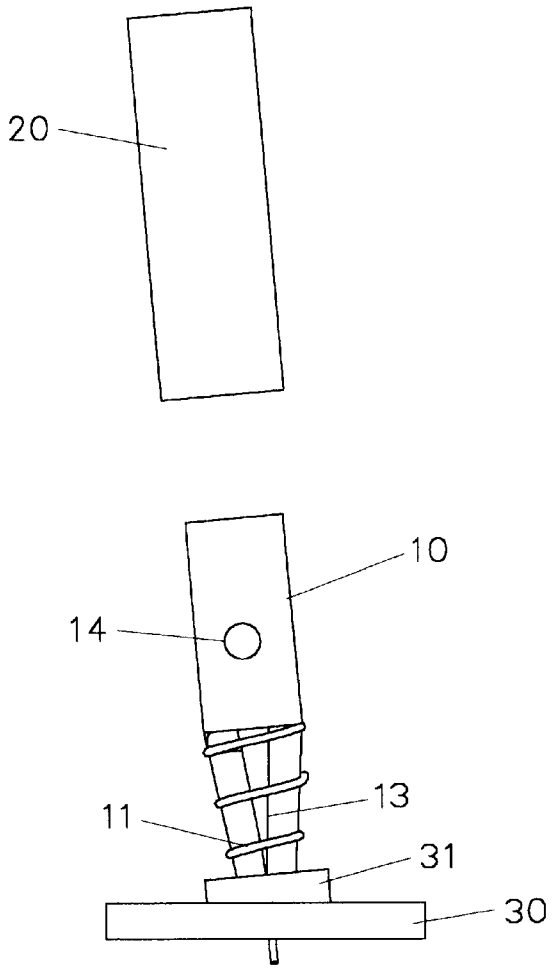
FIG. 4 is a partially front plan assembly view of the net fixing rack structure as shown FIG. 3.

As shown in FIG. 4, the base 30 is initially placed on the ground. Then, the screw portion 11 and the pin rod 13 of the fixing tube 10 are extended through the oblique through hole 31 of the base 30. Then, an object (not shown), such as a rod, is inserted into the transverse through hole 14 of the fixing tube 10 to rotate the fixing tube 10, so that the screw portion 11 of the fixing tube 10 is rotated by rotation of the fixing tube 10 and is displaced downward into the ground in a helical manner. Then, the fixing tube 10 is successively rotated and moved downward until the transverse through hole 14 of the fixing tube 10 is flush with the oblique through hole 31 of the base 30, thereby accomplishing the fixing operation, so that the screw portion 11 and the pin rod 13 of the fixing tube 10 are fixed in the ground.

Figure 5:
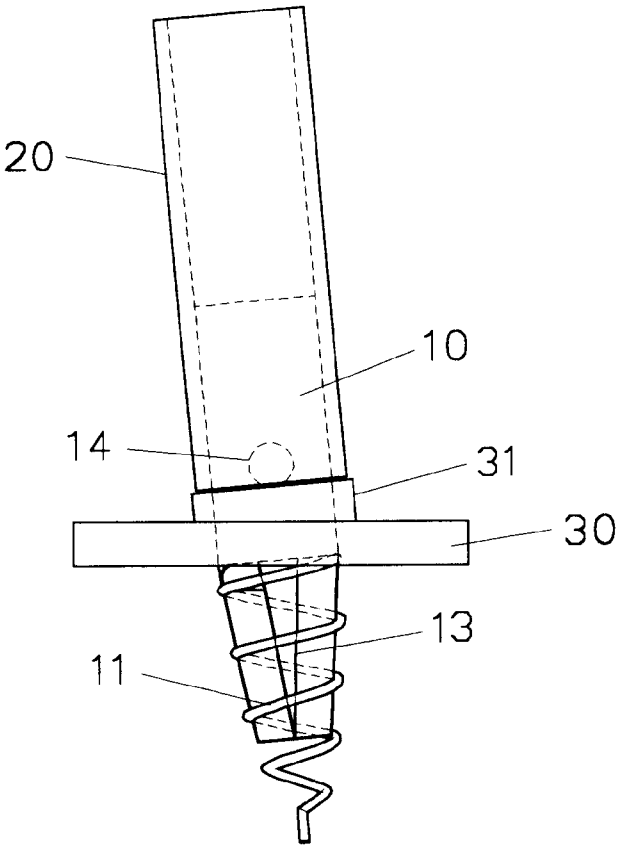
FIG. 5 is a front plan assembly view of the net fixing rack structure as shown in FIG. 3.

As shown in FIG. 5, the mounting tube 20 is mounted on the fixing tube 10, thereby assembling the net fixing rack structure in accordance with the present invention.

Figure 6:
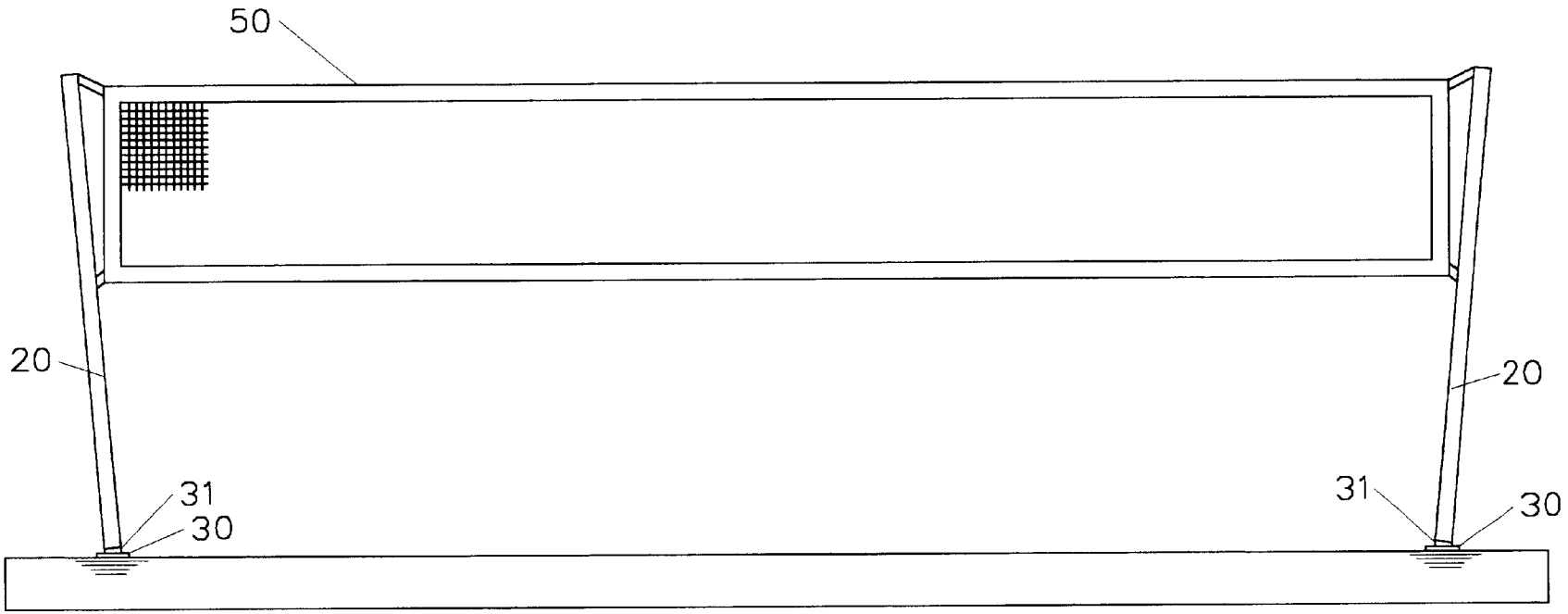
FIG. 6 is a schematic plan view showing the net fixing rack structure in accordance with the present invention being combined with a net.

As shown in FIG. 6, each of the two opposite sides of the net 50 is secured on the upper end of the mounting tube 20 of the net fixing rack structure in accordance with the present invention.

Figure 7:
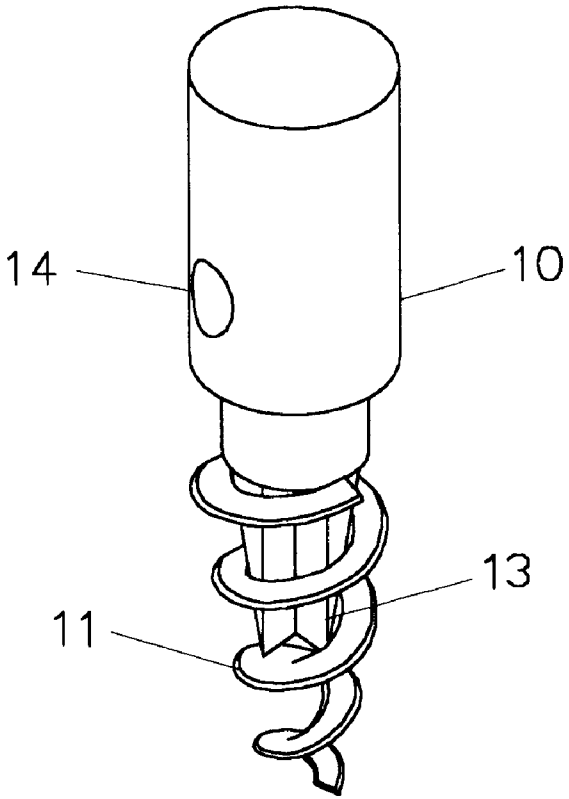
FIG. 7 is a perspective view of a net fixing rack structure in accordance with a second embodiment of the present invention.

Referring to FIG. 7, the net fixing rack structure in accordance with a second embodiment of the present invention is shown, wherein the screw portion 11 of the fixing tube 10 is enlarged, and presents a flat and smooth face.

Figure 8:
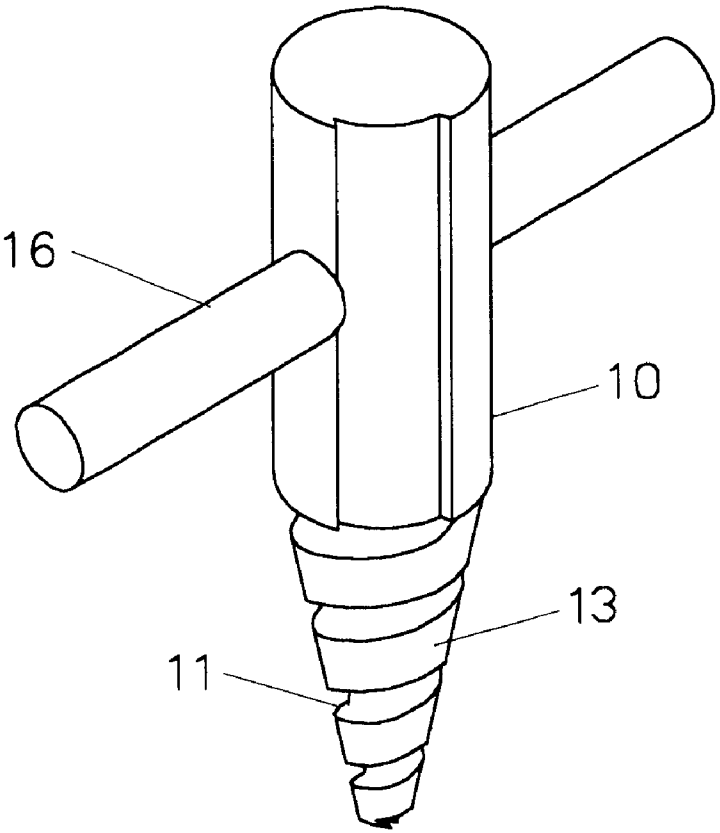
FIG. 8 is a perspective view of a net fixing rack structure in accordance with a third embodiment of the present invention.

Referring to FIG. 8, the net fixing rack structure in accordance with a third embodiment of the present invention further comprises an elongated rod 16 extended through the transverse through hole 14 of the fixing tube 10. Preferably, the elongated rod 16 is integrally formed in the transverse through hole 14 of the fixing tube 10. In addition, the screw portion 11 and the pin rod 13 of the fixing tube 10 are integrally formed with each other.

Accordingly, the net fixing rack structure in accordance with the present invention has the following advantages.

1. The oblique through hole 31 of the base 30 has a determined inclined angle, so that the fixing tube 10 is fixed in the ground with a determined inclined angle. Thus, after the whole net fixing rack structure is assembled, the mounting tube 20 is inclined relative to the ground with a determined angle, thereby enhancing the supporting effect of the net fixing rack structure.
2. When the fixing tube 10 is fixed in the ground, the screw portion 11 of the fixing tube 10 has a better grabbing effect, thereby enhancing the combination effect between the fixing tube 10 and the ground, so that the fixing tube 10 is fixed in the ground rigidly and stably.
3. The fixing tube 10 is successively rotated and moved downward until the transverse through hole 14 of the fixing tube 10 is flush with the oblique through hole 31 of the base 30, so that the user may assure that the fixing tube 10 is inserted into the ground to a determined depth, thereby enhancing the safety of mounting the net fixing rack structure.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A net fixing rack structure, comprising a base, a fixing tube, and a mounting tube, wherein:

the base is mounted on the ground, and is formed with an oblique through hole having a proper height;

the fixing tube is mounted on the base, and has a first end formed with a pin rod and a second end formed with a transverse through hole, the fixing tube includes a screw portion mounted on a periphery of the pin rod, the screw portion and the pin rod of the fixing tube are extended through the oblique through hole of the base; and the mounting tube is mounted on the fixing tube, and has a distal end connected to the oblique through hole of the base.

2. The net fixing rack structure in accordance with claim 1, wherein the screw portion of the fixing tube is enlarged, and presents a flat and smooth face.

3. The net fixing rack structure in accordance with claim 1, further comprising an elongated rod extended through the transverse through hole of the fixing tube.

4. The net fixing rack structure in accordance with claim 3, wherein the elongated rod is integrally formed in the transverse through hole of the fixing tube.

5. The net fixing rack structure in accordance with claim 1, wherein the screw portion and the pin rod of the fixing tube are integrally formed with each other.

* * * * *